US011732887B1

(12) United States Patent
Schwartz et al.

(10) Patent No.: US 11,732,887 B1
(45) Date of Patent: Aug. 22, 2023

(54) BRUSH BURNING TOOL

(71) Applicants: Jonathan Schwartz, Colfax, CA (US); Thomas Christian Kinsey, Colfax, CA (US); Benjamin William Schwartz, Colfax, CA (US); Nathan Schwinn Webb, Colfax, CA (US); Griffin Shahin Vernon, Colfax, CA (US); Peter Delphini Molino, III, Colfax, CA (US); Natalie Antoinette Lundberg, Colfax, CA (US); Holly Jane Wren, Colfax, CA (US)

(72) Inventors: Jonathan Schwartz, Colfax, CA (US); Thomas Christian Kinsey, Colfax, CA (US); Benjamin William Schwartz, Colfax, CA (US); Nathan Schwinn Webb, Colfax, CA (US); Griffin Shahin Vernon, Colfax, CA (US); Peter Delphini Molino, III, Colfax, CA (US); Natalie Antoinette Lundberg, Colfax, CA (US); Holly Jane Wren, Colfax, CA (US)

(73) Assignee: Placer Union High School District, Auburn, CA (US)

( * ) Notice: Subject to any disclaimer, the term of this patent is extended or adjusted under 35 U.S.C. 154(b) by 185 days.

(21) Appl. No.: 17/366,793

(22) Filed: Jul. 2, 2021

(51) Int. Cl.
*F23G 7/10* (2006.01)
*F23G 5/44* (2006.01)
*F23G 5/00* (2006.01)

(52) U.S. Cl.
CPC ..... *F23G 7/10* (2013.01); *F23G 5/002* (2013.01); *F23G 5/44* (2013.01); *F23G 2209/26* (2013.01)

(58) Field of Classification Search
CPC ..... F23G 5/44
See application file for complete search history.

(56) References Cited

U.S. PATENT DOCUMENTS 5,154,598 A * 10/1992 Gooderham ..... F23D 14/20 431/348
5,604,993 A * 2/1997 Auckerman ..... F26B 21/008 392/382
2007/0111305 A1* 5/2007 O'Neill ..... C05F 17/964 435/300.1
2016/0332175 A1* 11/2016 Fu ..... B08B 3/028
2017/0038142 A1* 2/2017 Schwegel ..... F26B 21/006

* cited by examiner

*Primary Examiner* — David J Laux
(74) *Attorney, Agent, or Firm* — Larry D. Johnson

(57) ABSTRACT

A brush burning tool includes a tubular metal shaft terminating in a hollow metal head portion, with a plurality of apertures arrayed around the head. A blower attached to the open end of the tubular metal shaft delivers air through the shaft and out through the apertures in the head portion to facilitate burning of a pile of biomass.

7 Claims, 1 Drawing Sheet

BRUSH BURNING TOOL

TECHNICAL FIELD

This written description relates generally to tools and hardware, and more particularly to an improved brush burning tool providing a more efficient way for a user to burn brush and other materials for, among other things, fire prevention.

BACKGROUND

Catastrophic wildfires are a reality of life and threaten the safety of families and homes. One way to mitigate the threat of fires is to dispose of the biomass that surrounds many homes. The best way to dispose of this biomass is to burn it during the nonfire season. The problems with this include the inefficiencies and mess of burning, the production of an incredible amount of smoke and particulate matter, and the difficulty of getting a fire started in the wet season.

SUMMARY

Described below is an improved brush burning tool. In some implementations, the tool includes a tubular metal shaft terminating in a hollow metal head portion, with a plurality of apertures arrayed around the head. In some implementations, a blower attached to the open end of the tubular metal shaft delivers air through the shaft and out through the apertures in the head portion.

In some implementations, the design of the brush burning tool channels air from a blower into the core of a fire, which allows the pile to burn quickly, despite being wet or extremely compact. When the tool is used, the biomass burns clean and releases very small amounts of smoke. The increased flow of oxygen also allows the fire to burn hotter, which increases the rate at which the biomass breaks down. Additionally, the increased heat allows the biomass to burn down further than a lower temperature fire, leaving less of a pile of coals afterward.

In some implementations, the brush burning tool introduces air into the burn pile in a variety of directions to create maximum airflow. In some implementations, there are no holes pointing upward so that no coals will be spread. This increased amount of air creates a much hotter center of the fire, which burns the biomass more thoroughly so that no particulate matter is produced. Additionally, this increased heat allows for almost any kind of biomass to begin burning very quickly, instead of a smoky and slow start.

In some implementations, the brush burning tool is made of high-quality steel that will not degrade or break down easily over time and can withstand the temperature of the fire. In some implementations, the tool can be disassembled to facilitate storage.

Particular embodiments of the subject matter described in this specification can be implemented so as to realize one or more of the following advantages.

In some implementations, use of the tool creates a more efficient and easy way for homeowners to burn their brush piles.

In some implementations, use of the tool enables the user to get rid of biomass in a quick, easy, environmentally friendly way.

In some implementations, use of the tool creates a centralized air source in the center of the burn pile, which helps to decrease the inefficiencies of burn piles.

In some implementations, use of the tool speeds burn time, which reduces supervision time.

In some implementations, use of the tool produces less residual material.

In some implementations, use of the tool generates a fire with cleaner smoke.

In some implementations, use of the tool enables easier ignition of a fire.

The details of one or more embodiments of the subject matter described in this specification are set forth in the accompanying drawings and the description below. Other features, aspects, and advantages of the subject matter will become apparent from the description, the drawings, and the claims.

Those skilled in the art will appreciate that the conception upon which this disclosure is based readily may be utilized as a basis for the designing of other structures, methods and systems that include one or more of the various features described below.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

DETAILED DESCRIPTION

Figure 1:
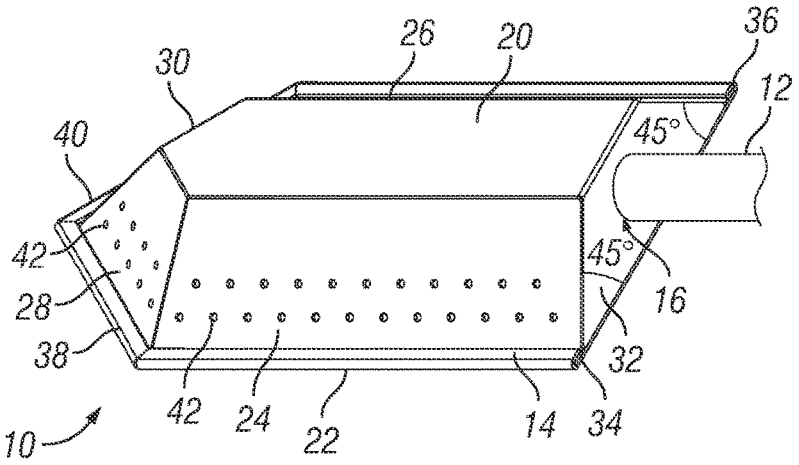
FIG. 1 is a perspective view of one implementation of a brush burning tool.
Figure 2:
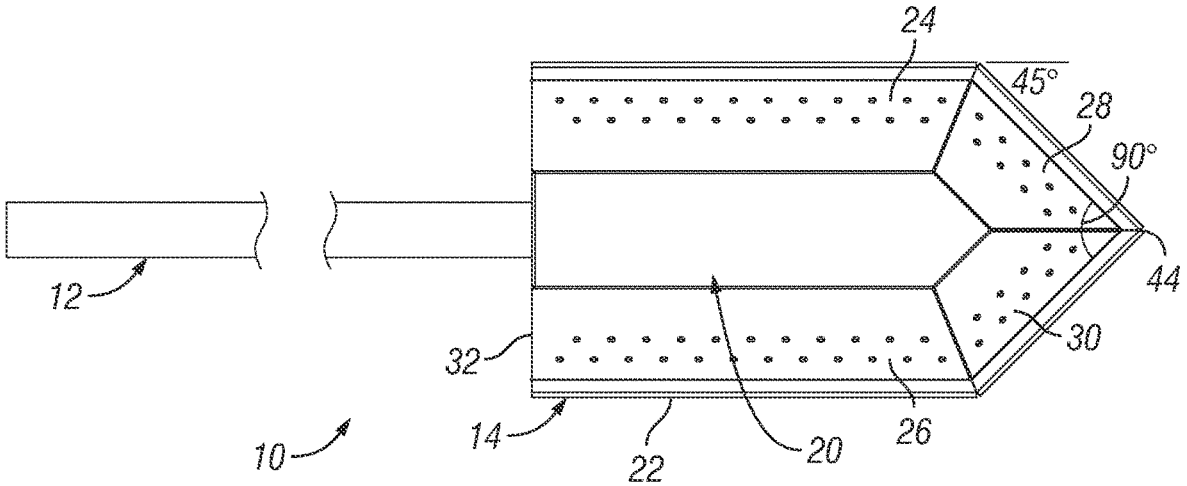
FIG. 2 is a top view of one implementation of a brush burning tool.
Figure 3:
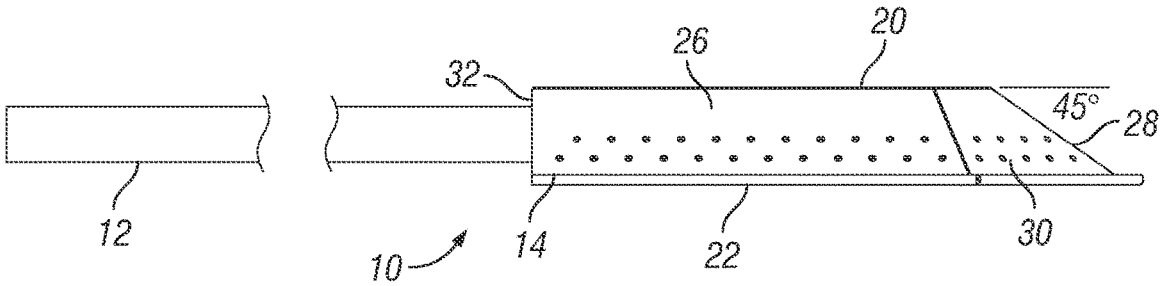
FIG. 3 is a side view of one implementation of a brush burning tool.

Referring to FIGS. 1 through 3, wherein like reference numerals refer to like components in the various views, there is illustrated therein implementations of a brush burning tool, generally denominated 10 herein.

FIG. 1 is a perspective view of one implementation of a brush burning tool 10, including tube portion 12 connected to head portion 14 at coupling 16, which may be a friction fit or other releasable connection enabling disassembly of the tube and head.

Head portion 14 may include a plurality of panels together defining a hollow polyhedron, at least some of the panels bearing a plurality of perforations or apertures permitting air flow through the head portion. In some implementations, the head portion includes a top panel, bottom panel, and inclined left and right side panels connecting the top and bottom panels and intersecting the bottom panel at an acute angle, for example 45 degrees. In some implementations, the head portion includes inclined left and right front panels connecting the top and bottom panels and intersecting the bottom panel at an acute angle, for example 45 degrees. In some implementations, the left and right front panels connect to each other at an angle, for example 90 degrees. In some implementations, the left and right front panels connect to the left and right side panels, respectively, at an acute angle, for example 45 degrees. This angularity in the panels provides a wedge shape for the head portion and facilitates insertion of the head portion into a pile of biomass for burning. In some implementations the head portion includes a rear panel, which may connect to the top, bottom, and side panels at right angles.

In some implementations, the inclined side panels and/or front panels include perforations or apertures. In some implementations, the top panel, bottom panel, and rear panel are unperforated. This arrangement facilitates passage of air into a pile of biomass, while limiting vertical airflow so that no coals will be spread.

In the implementation illustrated in FIG. 1, head portion 14 includes top panel 20, bottom panel 22, left side panel 24, right side panel 26, left front panel 28, right front panel 30, and rear panel 32. Left side panel 24 connects to bottom panel 22 at left side edge 34 at an acute angle, in this case 45 degrees. Right side panel 26 connects to bottom panel 22 at right side edge 36 at an acute angle, in this case 45 degrees. Similarly, left front panel 28 connects to bottom panel 22 at left front panel edge 38 at an acute angle, in this case 45 degrees, and right front panel 30 connects to bottom panel 22 at right front panel edge 40 at an acute angle, in this case 45 degrees.

In this implementation, left side panel 24, right side panel 26, left front panel 28, and right front panel 30 each bear perforations or apertures 42 (e.g., 0.25 inches in diameter).

FIG. 2 is a top view of a brush burning tool 10. This view illustrates that left and right front panels 28, 30 connect to each other at front edge 44 at an angle, for example 90 degrees; and that left and right front panels 28, 30 connect to the left and right side panels 24, 26, respectively, at an acute angle, for example 45 degrees.

Head portion 14 may be constructed in any appropriate size, and in the example implementation is approximately 22 inches long, 12 inches wide, and 4 inches high. Head portion 14 may be constructed from any suitable material, and in the example implementation is constructed of 0.119 cold rolled steel.

Tube portion 12 may be constructed in any appropriate size, and in the example implementation is approximately 72 inches long. Tube portion 12 may be constructed from any suitable material, and in the example implementation is constructed of 2 inch O.D., 0.095 wall steel tube.

FIG. 3 is a side view of a brush burning tool 10. This view illustrates that left and right front panels 28, 30 connect to and intersect top panel 20 at an acute angle, in this case 45 degrees. This angularity in the panels further facilitates insertion of the head portion into a pile of biomass for burning.

In some implementations, the brush burning tool creates a more efficient and easy way for homeowners to burn their brush piles. The tool creates a centralized air source in the center of the burn pile, which helps to decrease the inefficiencies of burn piles. This airflow is created by the long metal pole with the head portion attached. The entire device is hollow and has an input at the end to allow an attached blower to push air through to the head. When the air reaches the head, it escapes through a series of holes in the head. This allows for constant, high-intensity airflow to the center of the fire. This helps to allow the fire to start much faster and burn more intensely, as airflow is a necessity of an intensive fire. The increased intensity induces an environment that has much lower rates of smoke, which lowers levels of particulate matter. Additionally, it is effective at increasing the rate of burning, to allow for much larger amounts of biomatter to be fed into the fire.

Accordingly, the brush burning tool may be characterized as including a tube portion connected to head portion, the head portion including a plurality of panels together defining a hollow polyhedron, at least some of the panels bearing a plurality of apertures permitting air flow through the head portion, wherein the tube portion may be connected to a blower to deliver air through the tube portion and out through the apertures in the head portion to facilitate burning a pile of biomass.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A brush burning tool comprising:

a tube portion connected to head portion, the head portion including a plurality of panels together defining a hollow polyhedron, at least some of the panels bearing a plurality of apertures permitting air flow through the head portion, wherein the tube portion may be connected to a blower to deliver air through the tube portion and out through the apertures in the head portion to facilitate burning a pile of biomass.

2. The brush burning tool of claim 1 wherein the head portion includes a top panel, bottom panel, and inclined left and right side panels connecting the top and bottom panels and intersecting the bottom panel at an acute angle.

3. The brush burning tool of claim 2 wherein the head portion includes inclined left and right front panels connecting the top and bottom panels and intersecting the bottom panel at an acute angle.

4. The brush burning tool of claim 3 wherein the left and right front panels connect to each other at an angle.

5. The brush burning tool of claim 4 wherein the left and right front panels connect to the left and right side panels, respectively, at an acute angle.

6. The brush burning tool of claim 2 wherein the inclined left and right side panels include apertures.

7. The brush burning tool of claim 3 wherein the inclined left and right front panels include apertures.

* * * * *